US012128292B2

(12) United States Patent
DiBitetto

(10) Patent No.: US 12,128,292 B2
(45) Date of Patent: Oct. 29, 2024

(54) HIGH WHEEL SKATE

(71) Applicant: John Brian DiBitetto, Bradford, MA (US)

(72) Inventor: John Brian DiBitetto, Bradford, MA (US)

( * ) Notice: Subject to any disclaimer, the term of this patent is extended or adjusted under 35 U.S.C. 154(b) by 43 days.

(21) Appl. No.: 17/803,962

(22) Filed: Feb. 8, 2023

(65) Prior Publication Data

US 2024/0261661 A1 Aug. 8, 2024

(51) Int. Cl.
*A63C 17/00* (2006.01)
*A63C 17/04* (2006.01)

(52) U.S. Cl.
CPC ..... *A63C 17/006* (2013.01); *A63C 17/0073* (2013.01); *A63C 17/04* (2013.01); *A63C 2203/42* (2013.01); *A63C 2203/50* (2013.01)

(58) Field of Classification Search
CPC ..... A63C 17/006; A63C 17/0073; A63C 17/0033; A63C 17/04; A63C 2203/42
See application file for complete search history.

(56) References Cited

U.S. PATENT DOCUMENTS 1,632,997 A * 6/1927 Connolly ..... A63C 17/04 280/11.19
1,798,794 A * 3/1931 Harston ..... A63C 17/04 280/11.26
2,430,037 A * 11/1947 Vincent ..... A63C 17/04 280/11.209
6,398,229 B1 * 6/2002 Saylor ..... A63C 17/04 280/11.208
6,406,039 B1 * 6/2002 Chen ..... A63C 17/04 403/348
6,557,861 B2 * 5/2003 Saylor ..... A63C 17/04 280/11.208
8,186,693 B2 * 5/2012 Kortschot ..... A63C 17/04 280/11.19
2004/0140634 A1 * 7/2004 Chen ..... A63C 17/0093 280/11.212
2005/0116430 A1 * 6/2005 Chen ..... A63C 17/1409 280/11.27
2013/0001903 A1 * 1/2013 Ardestany ..... A63C 17/20 280/11.221
2023/0354954 A1 * 11/2023 Banjac ..... A63C 17/226

* cited by examiner

*Primary Examiner* — Brian L Swenson

(57) ABSTRACT

High W-Heels are stylish mobility devices, worn on each foot designed left and right, combining wheeled chassis below attached to fashionable boot above. Their unique three wheeled chassis design, featuring two same sized smaller diameter wheels in front (attached by axle) and a single larger diameter (high) wheel in the back, forms a triangle which provides the user the desirable combined stability of roller skates with the agility of roller blades. This forward leaning (high wheel) design aids momentum and promotes good posture while offering the renowned fashion of a stylish high-heeled demi-boot.

1 Claim, 5 Drawing Sheets

Perspective View

Perspective View

Left Side View

CHASSIS TOP VIEW BOOT REMOVED - NOT TO SCALE

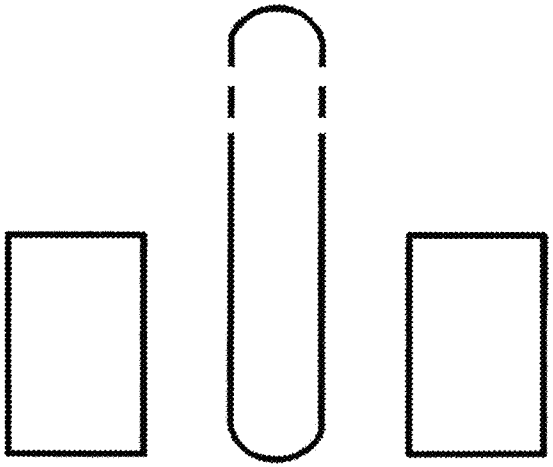
FIGURE 4. CHASSIS FRONT VIEW - NOT TO SCALE

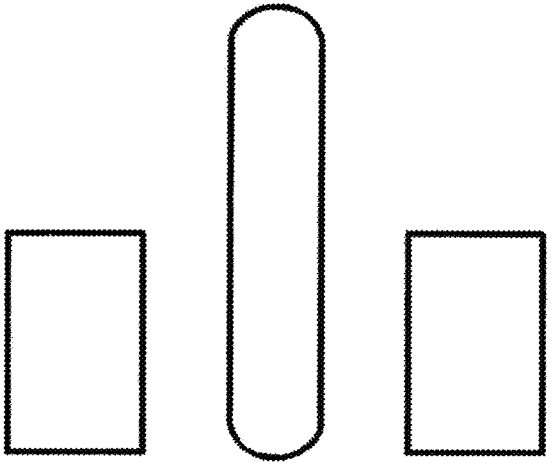
FIGURE 5. CHASSIS REAR VIEW - NOT TO SCALE

HIGH WHEEL SKATE

TECHNICAL FIELD

The present invention relates to wheeled skates.

BACKGROUND

Traditional roller skates with a pair of front and rear wheels and inline skates with the wheels provided in a single line are well established. However, the current designs do not provide a fashionable three-wheel design that combines the features of traditional roller skates and inline roller skates.

SUMMARY

The present disclosure provides a novel skate design. A unique three-wheel chassis design is provided that features two same sized smaller diameter wheels in front (connected by axle) and a single larger diameter (high) wheel in the back. This design forms a triangle which provides the user the desirable combined stability of roller skates with the agility of roller blades. This forward leaning (high wheel) design aids momentum and promotes good posture while offering the renowned fashion of a stylish high-heeled demi-boot.

BRIEF DESCRIPTION OF THE DRAWINGS

FIG. 4 is a front view of the chassis configuration without the boot;
FIG. 5 is a rear view of the chassis configuration without the boot;

DETAILED DESCRIPTION

Figure 1:
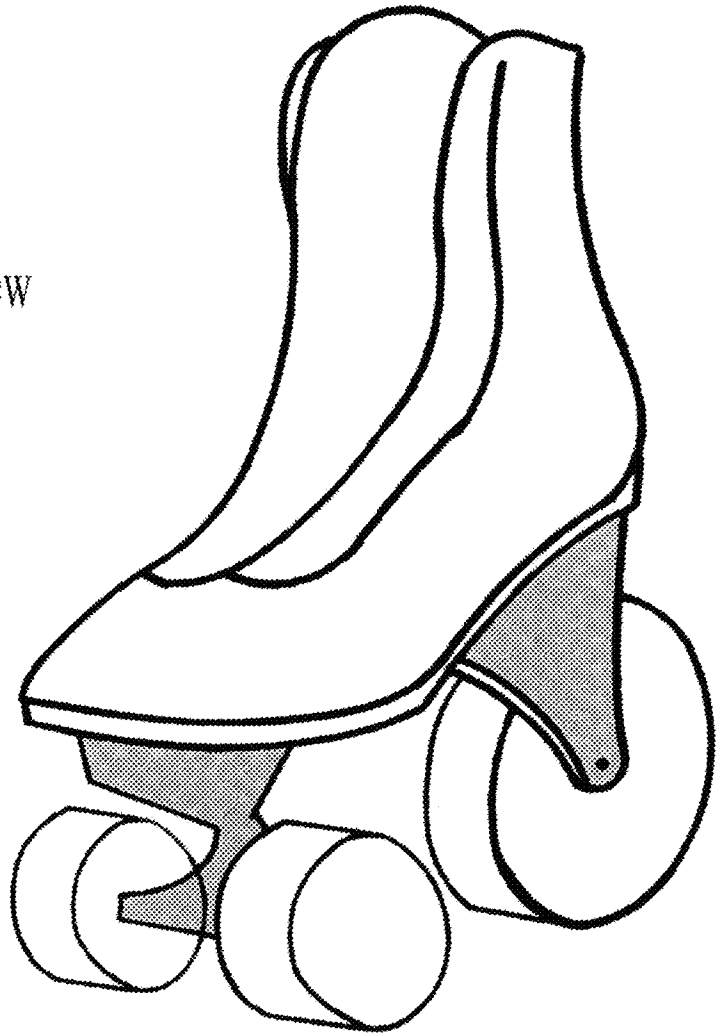
FIG. 1 is a perspective view of the skate.
Figure 2:
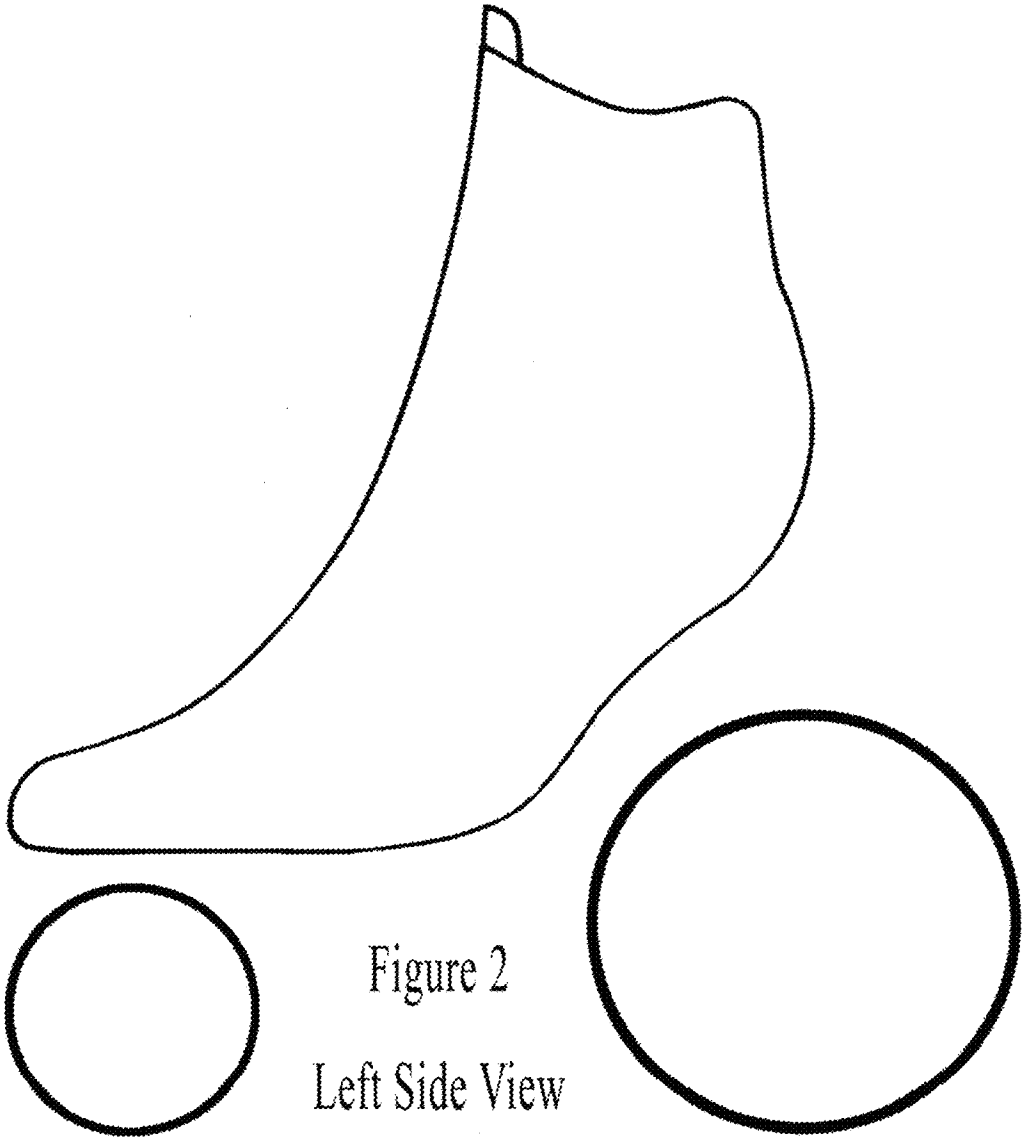
FIG. 2 is a left side view of the left skate.
Figure 3:
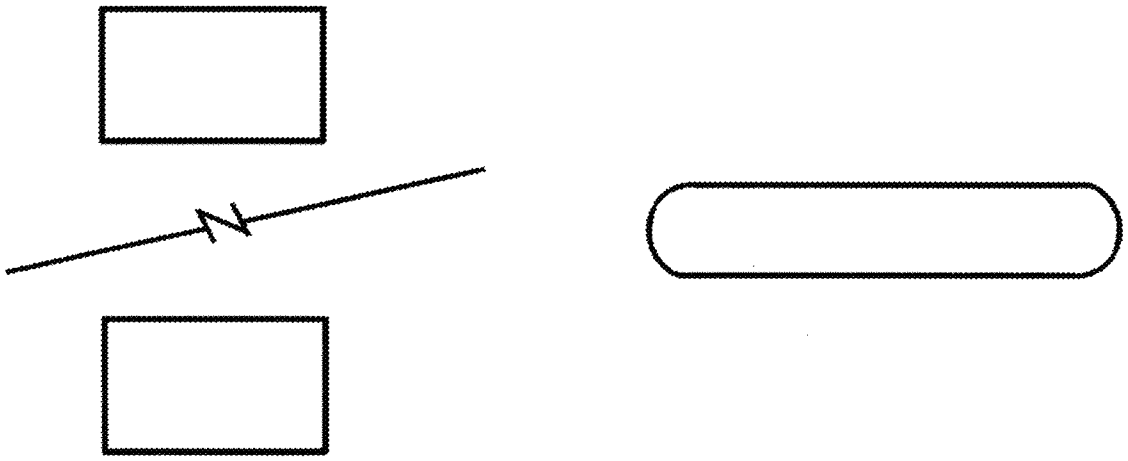
FIG. 3 is a chassis configuration without the boot.

A high wheeled stylish skate, worn on each foot is provided. As shown in the figures the unique three wheeled chassis design, features two same sized smaller diameter wheels in front (connected by axle) and a single larger diameter (high) wheel in the back. This design forms a triangle which provides the user the desirable combined stability of roller skates with the agility of roller blades. The forward leaning (high wheel) design aids momentum and promotes good posture while offering the renowned fashion of a stylish high-heeled demi-boot.

The invention claimed is:

1. A high wheeled skate for skating comprises:

a boot for receiving a foot of a user, where a heel portion of the boot is elevated relative to a forward section of the boot;

two forward wheels connected by axle provided below the forward section, the access of the axle is perpendicular to and equally staddles the lengthwise centerline of the boot;

a single rear wheel attached directly below the heel portion;

where the single rear wheel is larger in diameter than the two forward wheels, where the single rear wheel is located on the lengthwise centerline of the boot to a provide a triangular support base.

* * * * *